US006374787B2

(12) United States Patent
Simpson et al.

(10) Patent No.: US 6,374,787 B2
(45) **Date of Patent: *Apr. 23, 2002**

(54) MULTI-POSITION VARIABLE CAMSHAFT TIMING SYSTEM ACTUATED BY ENGINE OIL PRESSURE

(75) Inventors: Roger T. Simpson, Ithaca; Michael Duffield, Willseyville; Marty Gardner, Ithaca, all of NY (US)

(73) Assignee: BorgWarner Inc., Troy, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/879,570

(22) Filed: Jun. 12, 2001

Related U.S. Application Data

(63) Continuation of application No. 09/473,804, filed on Dec. 28, 1999, now Pat. No. 6,247,434.

(51) Int. Cl.[7] ..... F01L 1/344
(52) U.S. Cl. ..... 123/90.17; 123/90.31
(58) Field of Search ..... 123/90.15, 90.17, 123/90.31

(56) References Cited

U.S. PATENT DOCUMENTS 2,861,557 A * 11/1958 Stolte ..... 123/90.15
4,858,572 A * 8/1989 Shirai et al. ..... 123/90.12
5,107,804 A * 4/1992 Becker et al. ..... 123/90.17
5,797,361 A * 8/1998 Mikame et al. ..... 123/90.17
5,816,204 A * 10/1998 Moriya et al. ..... 123/90.17
5,836,275 A * 11/1998 Sato ..... 123/90.17
6,053,138 A * 4/2000 Trzmiel et al. ..... 123/90.17
6,058,897 A * 5/2000 Nakayoshi ..... 123/90.17
6,085,708 A * 7/2000 Trzmiel et al. ..... 123/90.17
6,105,543 A * 8/2000 Ogawa ..... 123/90.17
6,129,063 A * 10/2000 Niethammer et al. .... 123/90.17

FOREIGN PATENT DOCUMENTS

EP 924392 * 6/1999

* cited by examiner

*Primary Examiner*—Weilun Lo
(74) *Attorney, Agent, or Firm*—Emch, Schaffer, Schaub & Porcello Co., L.P.A.; Greg Dziegielewski

(57) ABSTRACT

A hub is secured to a camshaft for rotation synchronous with the camshaft, and a housing circumscribes the hub and is rotatable with the hub and the camshaft and is further oscillatable with respect to the hub and the camshaft within a predetermined angle of rotation. Driving vanes are radially disposed within the housing and cooperate with an external surface on the hub, while driven vanes are radially disposed in the hub and cooperate with an internal surface of the housing. A locking device, reactive to oil pressure, prevents relative motion between the housing and the hub. A controlling device controls the oscillation of the housing relative to the hub.

23 Claims, 10 Drawing Sheets

MULTI-POSITION VARIABLE CAMSHAFT TIMING SYSTEM ACTUATED BY ENGINE OIL PRESSURE

CROSS REFERENCE TO RELATED APPLICATIONS

The present application is a continuation of co-pending application Ser. No. 09/473,804, filed Dec. 28, 1999, now U.S. Pat. No. 6,247,434, and is related to pending application Ser. No. 09/450,456, filed Nov. 29, 1999, now U.S. Pat. No. 6,250,265, and entitled "Variable Valve Timing With Actuator Locking for Internal Combustion Engine", by inventor Roger T. Simpson. Additionally, the present application is related to copending application Ser. No. 09/488,903 and entitled "Multi-Position Variable Cam Timing System Having a Vane-Mounted Locking-Piston Device", by inventors Roger T. Simpson, and Michael Duffield, and thus is incorporated by reference herein. Finally, the application Ser. No. 09/592,624, now U.S. Pat. No. 6,263,846, and entitled "Control Valve Strategy for Vane-Type Variable Camshaft Timing System", by inventors Roger T. Simpson and Michael Duffield and thus is also incorporated by reference herein.

BACKGROUND OF THE INVENTION

1. Field of the Invention

The present invention generally relates to an internal combustion engine having a hydraulic control system for controlling the operation of a variable camshaft timing (VCT) system of the type in which the position of the camshaft is circumferentially varied relative to the position of a crankshaft in reaction to engine oil pressure. In such a VCT system, an electro-hydraulic control system is provided to effect the repositioning of the camshaft and a locking system is provided to selectively permit or prevent the electro-hydraulic control system from effecting such repositioning.

More specifically, this invention relates to a multi-position VCT system actuated by engine oil pressure and having a large number of thin, spring-biased vanes defining alternating fluid chambers therein.

2. Description of the Prior Art

It is known that the performance of an internal combustion engine can be improved by the use of dual camshafts, one to operate the intake valves of the various cylinders of the engine and the other to operate the exhaust valves. Typically, one of such camshafts is driven by the crankshaft of the engine, through a sprocket and chain drive or a belt drive, and the other of such camshafts is driven by the first, through a second sprocket and chain drive or a second belt drive. Alternatively, both of the camshafts can be driven is by a single crankshaft-powered chain drive or belt drive. It is also known that the performance of an internal combustion engine having dual camshafts, or but a single camshaft, can be improved by changing the positional relationship of a camshaft relative to the crankshaft.

It is also known that engine performance in an engine having one or more camshafts can be improved, specifically in terms of idle quality, fuel economy, reduced emissions, or increased torque. For example, the camshaft can be "retarded" for delayed closing of intake valves at idle for stability purposes and at high engine speed for enhanced output. Likewise, the camshaft can be "advanced" for premature closing of intake valves during mid-range operation to achieve higher volumetric efficiency with correspondingly higher levels of torque. In a dual-camshaft engine, retarding or advancing the camshaft is accomplished by changing the positional relationship of one of the camshafts, usually the camshaft that operates the intake valves of the engine, relative to the other camshaft and the crankshaft. Accordingly, retarding or advancing the camshaft varies the timing of the engine in terms of the operation of the intake valves relative to the exhaust valves, or in terms of the operation of the valves relative to the position of the crankshaft.

Heretofore, many VCT systems incorporated hydraulics including an oscillatable vane having opposed lobes and being secured to a camshaft within an enclosed housing. Such a VCT system often includes fluid circuits having check valves, a spool valve and springs, and electromechanical valves to transfer fluid within the housing from one side of a vane lobe to the other, or vice versa, to thereby oscillate the vane with respect to the housing in one direction or the other. Such oscillation is effective to advance or retard the position of the camshaft relative to the crankshaft. These VCT systems are typically "self-powered" and have a hydraulic system actuated in response to torque pulses flowing through the camshaft.

Unfortunately, the above VCT systems may have several drawbacks. One drawback with such VCT systems is the requirement of the set of check valves and the spool valve. The check valves are necessary to prevent back flow of oil pressure during periods of torque pulses from the camshaft. The spool valve is necessary to redirect flow from one fluid chamber to another within the housing. Using these valves involves many expensive high precision parts that further necessitate expensive precision machining of the camshaft.

Additionally, these precision parts may be easily fouled or jammed by contamination inherent in hydraulic systems. Relatively large contamination particles often lodge between lands on the spool valve and lands on a valve housing to jam the valve and render the VCT inoperative. Likewise, relatively small contamination particles may lodge between the outer diameter of the check or spool valve and the inner diameter of the valve housing to similarly jam the valve. Such contamination problems are typically approached by targeting a "zero contamination" level in the engine or by strategically placing independent screen filters in the hydraulic circuitry of the engine. Such approaches are known to be relatively expensive and only moderately effective to reduce contamination.

Another problem with such VCT systems is the inability to properly control the position of the spool during the initial start-up phase of the engine. When the engine first starts, it takes several seconds for oil pressure to develop. During that time, the position of the spool valve is unknown. Because the system logic has no known quantity in terms of position with which to perform the necessary calculations, the control system is prevented from effectively controlling the spool valve position until the engine reaches normal operating speed. Finally, it has been discovered that this type of VCT system is not optimized for use with all engine styles and sizes. Larger, higher-torque engines such as V-8's produce torque pulses sufficient to actuate the hydraulic system of such VCT systems. Regrettably however, smaller, lower-torque engines such as four and six cylinder's may not produce torque pulses sufficient to actuate the VCT hydraulic system.

Other VCT systems incorporate system hydraulics including a hub having multiple circumferentially spaced vanes cooperating within an enclosed housing having multiple circumferentially opposed walls. The vanes and the walls cooperate to define multiple fluid chambers, and the vanes divide the chambers into first and second sections. For example Shirai et al., U.S. Pat. No. 4,858,572, teaches use of such a system for adjusting an angular phase difference between an engine crankshaft and an engine camshaft. Shirai et al. further teaches that the circumferentially opposed walls of the housing limit the circumferential travel of each of the vanes within each chamber.

Shirai et al. discloses fluid circuits having check valves, a spool valve and springs, and electromechanical valves to transfer fluid within the housing from the first section to the second section, or vice versa, to thereby oscillate the vanes and hub with respect to the housing in one direction or the other. Shirai et al. further discloses a first connecting means for locking the hub and housing together when each vane is in abutment with one of the circumferentially opposed walls of each chamber. A second connecting means is provided for locking the hub and housing together when each vane is in abutment with the other of the circumferentially opposed walls of each chamber. Such connecting means are effective to keep the camshaft position either fully advanced or fully retarded relative to the crankshaft.

Unfortunately, Shirai et al. has several shortcomings. First, the previously mentioned problems involved with using a spool valve and check valve configurations are applicable to Shirai et al. Second, this arrangement appears to be limited to a total of only 15 degrees of phase adjustment between crankshaft position and camshaft position. The more angle of cam rotation, the more opportunity for efficiency and performance gains. Thus, only 15 degrees of adjustment severely limits the efficiency and performance gains compared to other systems that typically achieve 30 degrees of cam rotation. Third, this arrangement is only a two-position configuration, being positionable only in either the fully advanced or fully retarded positions with no positioning in-between whatsoever. Likewise, this configuration limits the efficiency and performance gains compared to other systems that allow for continuously variable angular adjustment within the phase limits.

Therefore, what is needed is a VCT system that is designed to overcome the problems associated with prior art variable camshaft timing arrangements by providing a variable camshaft timing system that performs well with all engine styles and sizes, packages at least as tightly as prior art VCT hardware, eliminates the need for check valves and spool valves, provides for continuously variable camshaft to crankshaft phase adjustment within its operating limits, and provides substantially more than 15 degrees of phase adjustment between the crankshaft position and the camshaft position.

SUMMARY OF THE INVENTION

According to the present invention there is provided a Variable Camshaft Timing (VCT) system that is designed to overcome the problems associated with prior art variable camshaft timing arrangements. The present invention provides a variable camshaft timing system that performs well with all engine styles and sizes, packages at least as tightly as prior art VCT hardware, eliminates the need for check valves and spool valves, provides for continuously variable camshaft to crankshaft phase adjustment within its operating limits, and provides substantially more than 15 degrees of phase adjustment between the crankshaft position and the camshaft position.

In one form of the invention, there is provided a camshaft and a hub secured to the camshaft for rotation synchronous with the camshaft. A housing circumscribes the hub and is rotatable with the hub and the camshaft and is further oscillatable with respect to the hub and the camshaft within a predetermined angle of rotation. A plurality of driving vanes is radially disposed in the housing and cooperates with an external surface on the hub. Likewise, a plurality of driven vanes is radially disposed in the hub and cooperates with an internal surface of the housing. A locking arrangement reactive to oil pressure is provided for preventing relative motion between the housing and the hub at any of a multitude of circumferential positions of the housing and the hub relative to one another, Finally, a configuration for controlling the oscillation of the housing relative to the hub is provided.

Accordingly, it is an object of the present invention to provide an improved variable camshaft timing arrangement for an internal combustion engine.

It is another object to provide a variable camshaft timing arrangement in which the position of a camshaft is continuously variable relative to the position of the crankshaft within its operating limits.

It is still another object to provide a hydraulically operated variable camshaft timing arrangement of relatively simplified mechanical and hydraulic construction in contrast to an arrangement that requires check valves and spool valves.

It is yet another object to provide an improved VCT system that performs with all engine styles and sizes.

It is a further object to provide a VCT system that packages as tightly as previous VCT systems and eliminates the need for check valves and spool valves, It is still a further object to provide a VCT that provides for continuously variable camshaft to crankshaft phase adjustment within its operating limits, and that provides at least approximately 30 degrees of phase adjustment between the crankshaft position and the camshaft position.

These objects and other features, aspects, and advantages of this invention will be more apparent after a reading of the following detailed description, appended claims, and accompanying drawings.

DETAILED DESCRIPTION OF THE PREFERRED EMBODIMENT

In general, a hydraulic timing system is provided for varying the phase of one rotary member relative to another rotary member. More particularly, the present invention provides a multi-position Variable camshaft Timing (VCT) system powered by engine oil for varying the timing of a camshaft of an engine relative to a crankshaft of an engine to improve one or more of the operating characteristics of the engine. While the present invention will be described in detail with respect to internal combustion engines, the VCT system is also well suited to other environments using hydraulic timing devices. Accordingly, the present invention is not limited to only internal combustion engines.

Figure 1:
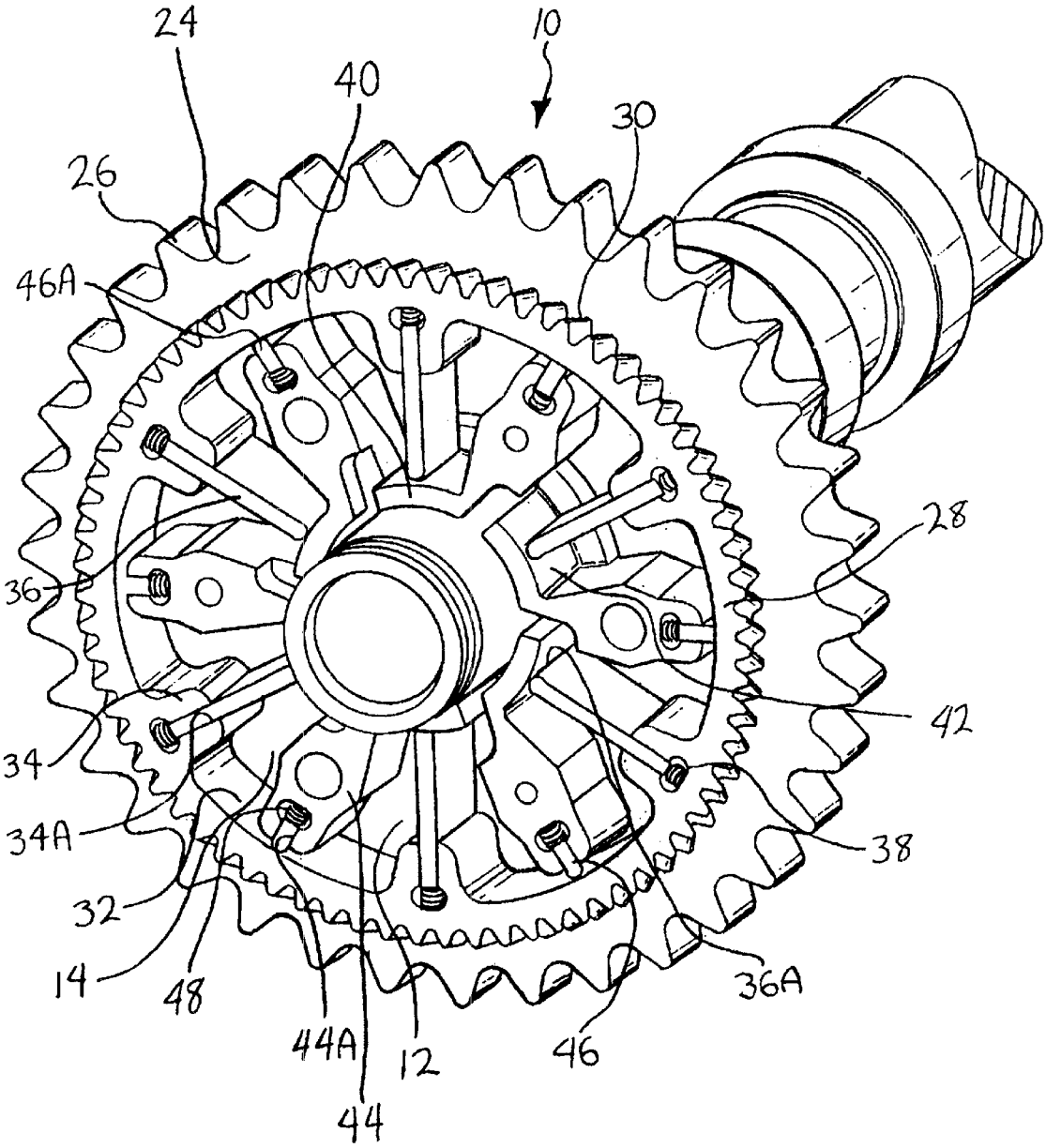
FIG. 1 is a perspective view of a camshaft and vane phaser according to the present invention.
Figure 2:
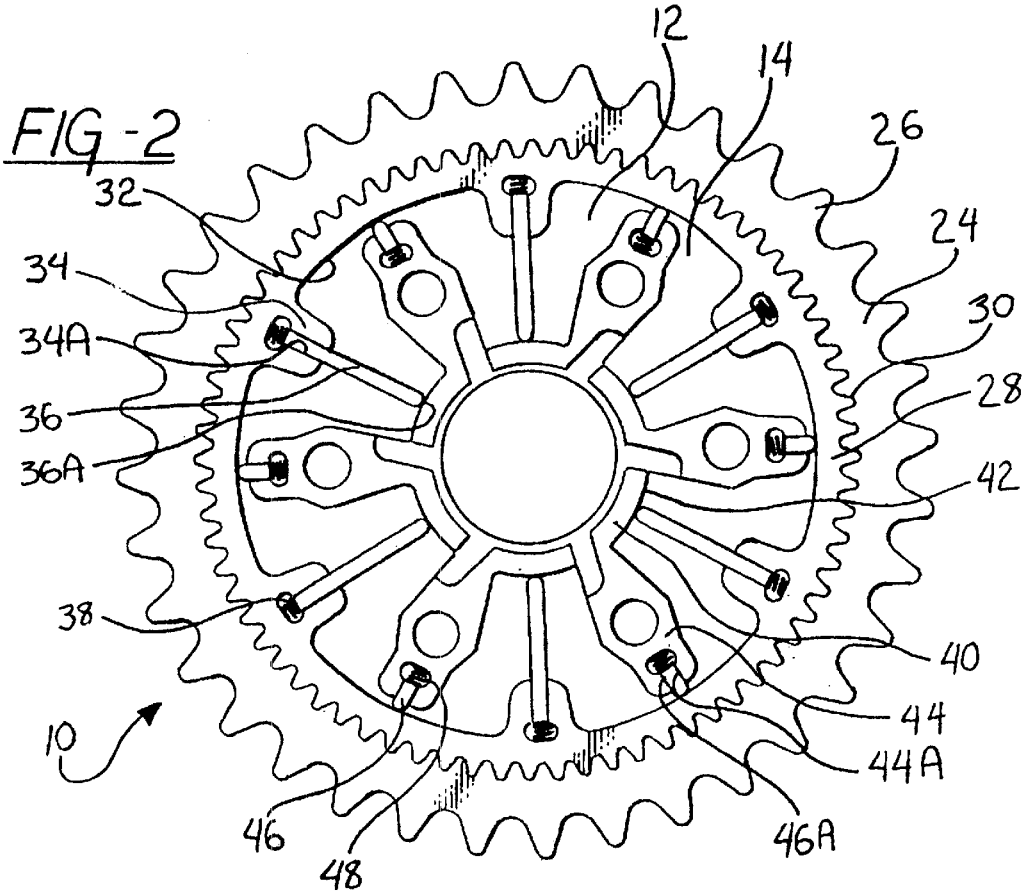
FIG. 2 is an end view of the camshaft and vane phaser of FIG. 1.

Referring now in detail to the Figures, there is shown in FIGS. 1 and 2 a vane phaser 10 according to the preferred embodiment of the present invention. The vane phaser 10 includes a housing 24 or sprocket circumscribing a hub 40. The housing 24 includes sprocket teeth 26 disposed about its periphery and an annular array of locking teeth 30 disposed about a locking diameter 28. The housing 24 farther includes an internal surface 32 and internal lobes 34 circumferentially spaced apart with a radial slot 34a in each lobe. Each radial slot 34*a* extends outwardly and is open to the internal surface 32. The housing 24 includes a driving vane 36 radially and slidably disposed in each radial slot 34*a*. Each driving vane 36 has an inner edge 36*a* that engages an external surface 42 of the hub 40. Each driving vane 36 is spring-loaded by a bias member or spring 38 radially inwardly to ensure constant contact with the external surface 42 of the hub 40.

The hub 40 includes external lobes 44 circumferentially spaced apart, around an external surface 42, and a radial slot 44*a* in each external lobe 44. The hub 40 includes a driven vane 46 radially and slidably disposed in each radial slot 44*a*. Each driven vane 46 has an outer edge 46*a* that engages the internal surface 32 of the housing 24. Each driven vane 46 is biased radially outwardly by a bias member or spring 48 to ensure constant contact with the internal surface 32 of the housing 24. In that regard, each outer edge 46A of each driven vane 46 of the hub 40 slidably cooperates with the internal surface 32 of the housing 24. Likewise, each inner edge 36A of each driving vane 36 of the housing 24 slidably cooperates with the external surface 42 of the hub 40 to permit limited relative movement between the hub 40 and the housing 24.

The driving and driven vanes 36 and 46 are alternately circumferentially interspersed to define advance chambers 12 and retard chambers 14. Therefore, the advance and retard chambers 12 and 14 are also alternately circumferentially interspersed between the hub 40 and the housing 24. In addition, the advance and retard chambers 12 and 14 are fluid tightly separated from one another.

Figure 3:
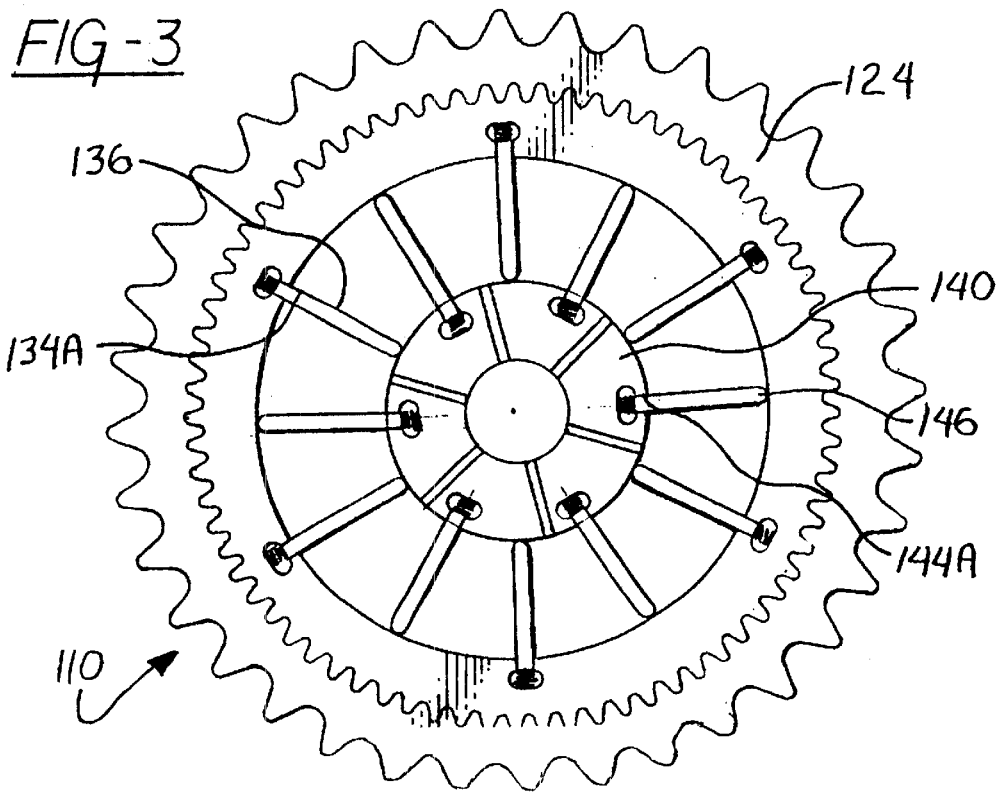
FIG. 3 is an end view of another camshaft having a vane phaser according to the present invention.

FIG. 3 illustrates another vane phaser 110 according to an alternative embodiment of the present invention. Here the vane phaser 110 design is more similar to ordinary vane pump design and includes a rotor or hub 140 and housing 124. In contrast to the vane phaser 10 of FIGS. 1 and 2, this vane phaser 110 has no lobes. Rather, a driven vane 146 is disposed in each radial slot 144 in the hub 140 and a driving vane 136 is disposed in each radial slot 134 in the housing 124.

Figure 4:
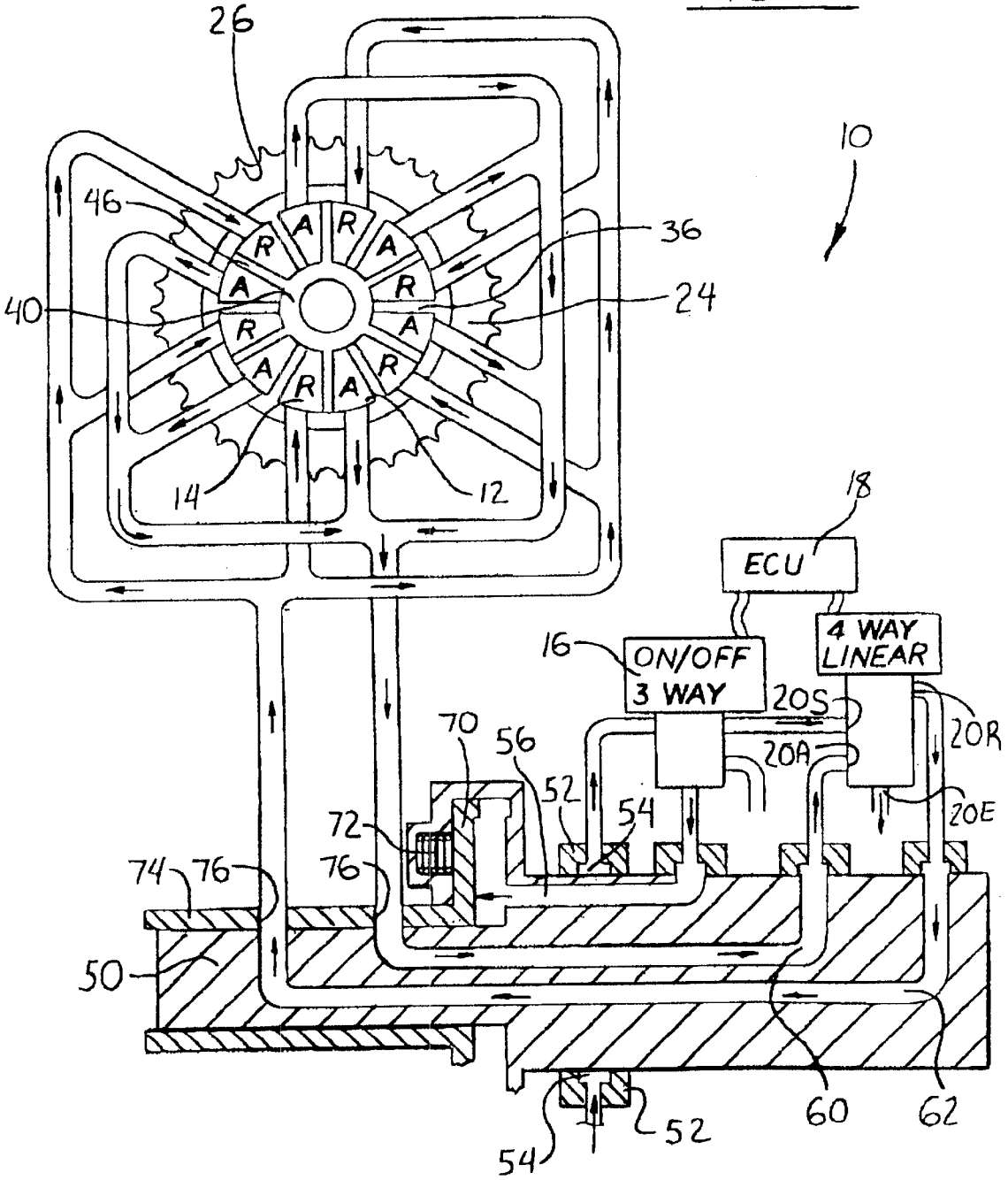
FIG. 4 is a schematic view of the hydraulic equipment of the camshaft and vane phaser arrangement according to the preferred embodiment of the present invention and illustrates a phase shift where the position of the camshaft is changing from neutral position to a retard position.
Figure 6:
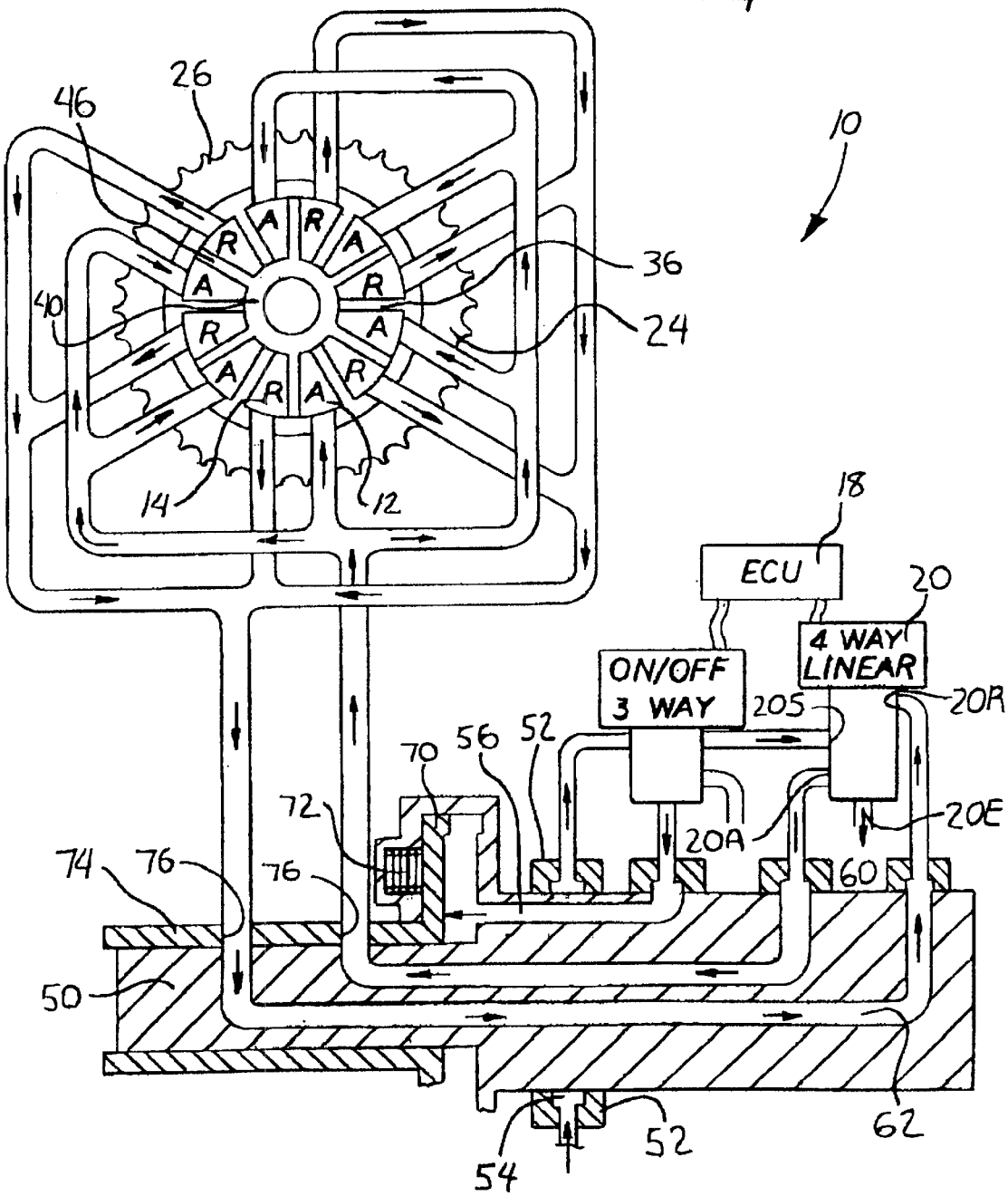
FIG. 6 is a schematic view of the hydraulic equipment of the variable cam timing arrangement according to the preferred embodiment of the present invention and illustrates a phase shift where the position of the camshaft is changing from neutral position to an advance position.
Figure 7:
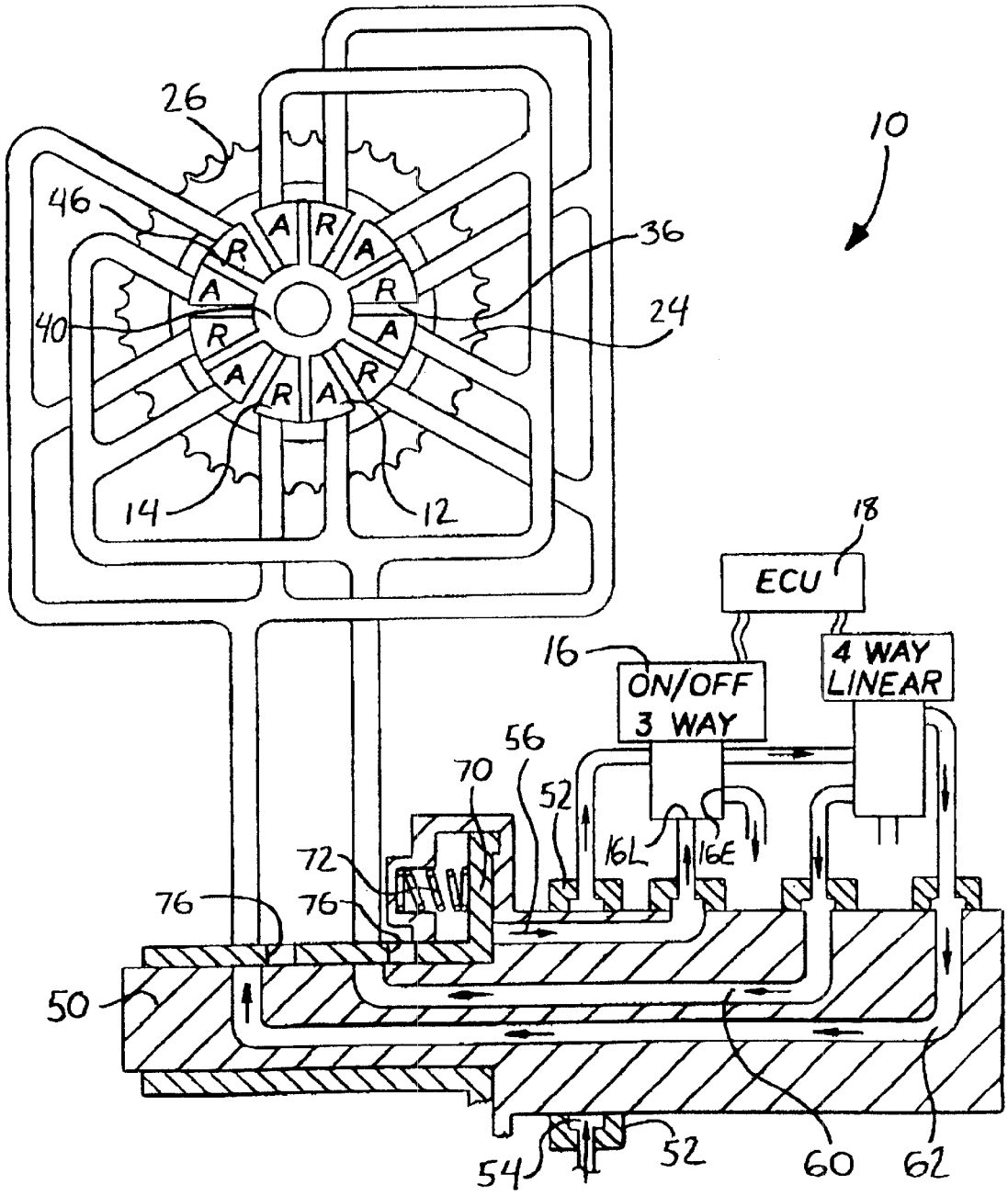
FIG. 7 is a schematic view of the hydraulic equipment of the variable camshaft timing arrangement according to the preferred embodiment of the present invention and illustrates a locked condition where the position of the camshaft is neutral and the housing is locked to the camshaft.

Referring now to FIGS. 4, 6, and 7, the vane phaser 10 of the variable camshaft timing system according to the preferred embodiment of the present invention is provided in schematic form. The vane phaser 10 includes the housing 24 having the driving vanes 36 extending inwardly therefrom. The hub 40 includes the driven vanes 46 extending outwardly therefrom. The hub 40 is keyed or otherwise secured to a camshaft 50 to be rotatable therewith, but not oscillatable with respect thereto. The assembly that includes the camshaft 50 with the hub 40 and housing 24 is caused to rotate by torque applied to the housing 24 by an endless chain (not shown) that engages the sprocket teeth 26, so that motion is imparted to the endless chain by a rotating crankshaft (not shown). The housing 24, rotates with the camshaft 50 and is oscillatable with respect to the camshaft 50 to change the phase of the camshaft 50 relative to the crankshaft.

A locking arrangement is enabled using pressurized engine oil that flows a into the camshaft 50 by way of a supply passage 54 in a camshaft bearing 52 (as indicated by the directional arrows). The engine oil flows first to a 3-way on/off flow control valve 16 whose operation is controlled by an electronic engine control unit (ECU) 18. As shown in FIGS. 4 and 6, when the 3-way valve 16 is on, oil flows through the 3-way valve 16 into a locking passage 56 in the camshaft 50 against a locking plate 70. The oil pressure thereby urges the locking plate 70, against the force of a return spring 72, to a position where the locking plate 70 maintains the vane phaser 10 in an unlocked condition by structure that will hereinafter be described in greater detail. In FIG. 7, however, the 3-way valve 16 is off and no engine oil, therefore, will flow into the locking passage 56, whereupon the return spring 72 will return the locking plate 70 to its locked position.

Figure 5:
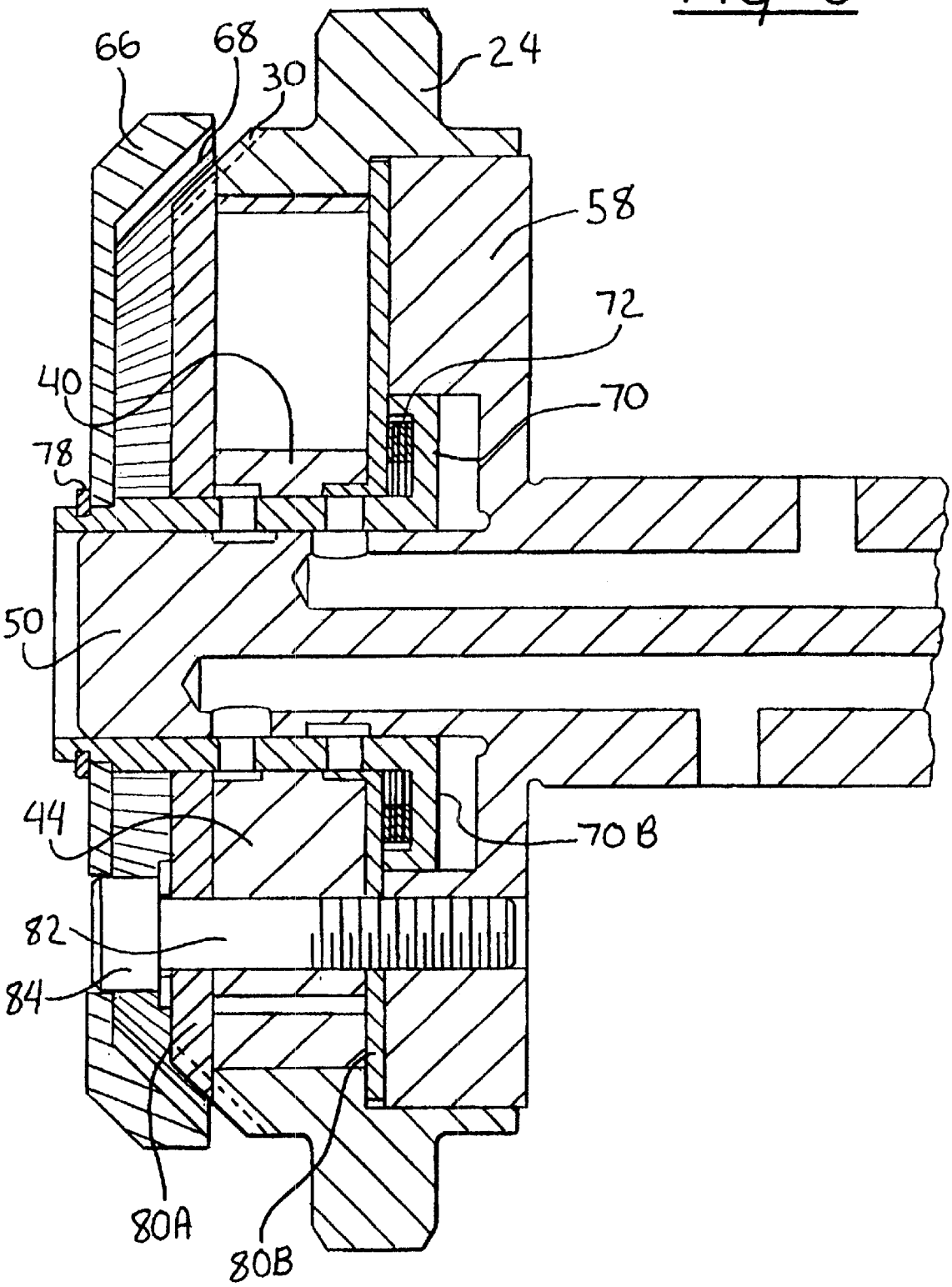
FIG. 5 is a cross-sectional view of components of the variable camshaft timing system of the present invention in the position of such components as illustrated in FIGS. 4 and 6.
Figure 8:
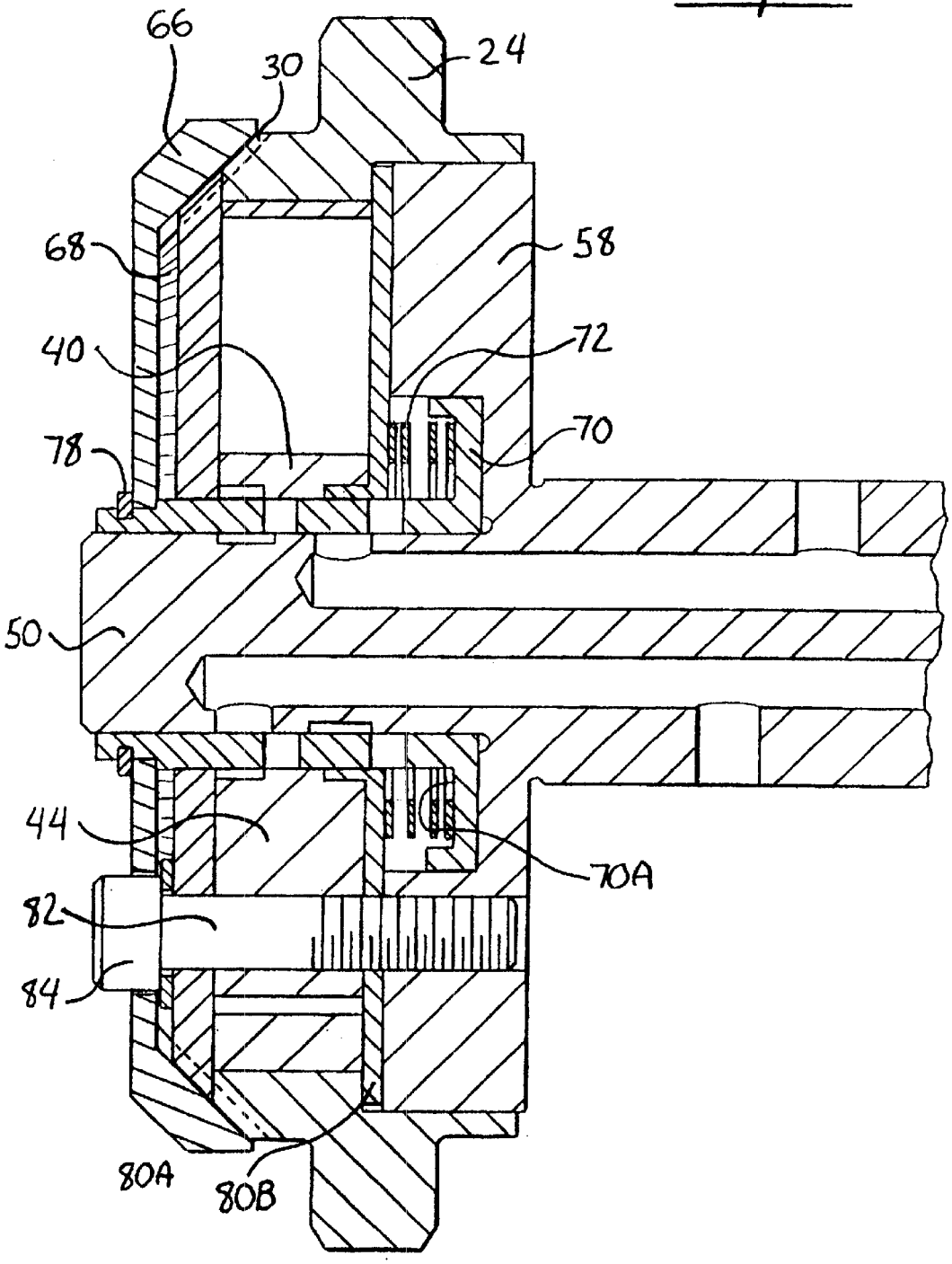
FIG. 8 is a cross-sectional view of components of the variable camshaft timing system of the present invention in the position of such components as illustrated in FIG. 7.

Referring now to FIGS. 5 and 8, the locking plate 70 is in the form of an annular member that is coaxially positioned relative to the longitudinal central axis of the camshaft 50. A locking ring 66 is provided with an annular array of locking teeth 68 that is positioned to engage the locking teeth 30 on the housing 24 when the locking plate 70 moves along the longitudinal central axis of the camshaft 50 from the unlocked position shown in FIG. 5 to the locked position shown in FIG. 8. As heretofore explained in connection with FIGS. 4, 6, and 7, the locking plate 70 is biased toward its locked position of FIG. 8 by the return spring 72, which bears against an axial surface 70A of the locking plate 70 to which the locking ring 66 is secured by a snap ring 78. The locking plate 70 is urged to its unlocked position of FIG. 5 by hydraulic pressure through the locking passage 56 shown in FIGS. 4, 6, and 7. The hydraulic pressure bears against an axial surface 70B of the locking plate 70 that is opposed to the axial surface 70A acted upon by the return spring 72.

As heretofore explained, the locking plate 70 is incapable of circumferential movement relative to the camshaft 50, whereas the housing 24 is capable of circumferential movement relative to the camshaft 50. For this reason, and because of the multitude of intercommunicating locking teeth 30 and 68, the locking plate 70 and locking ring 66 are capable of locking the housing 24 in a fixed circumferential position relative to the camshaft 50 at a multitude of relative circumferential positions therebetween. This occurs whenever hydraulic pressure in the locking passage (not shown) falls below a predetermined value needed to overcome the force of the return spring 72.

As shown in FIGS. 5 and 8, the housing 24 is open at either axial end but is closed off by separate spaced apart end plates 80*a* and 80*b*. The assembly that includes the locking plate 70, the end plates 80*a* and 80*b*, the housing 24, and the hub 40 is secured to an annular flange 58 of the camshaft 50 by bolts 82 each of which passes through each of the external lobes 44 of the hub 40. In that regard, the locking plate 70 is slidable relative to a head 84 of each bolt 82, as can be seen by comparing the relative unlocked and locked positions of FIGS. 5 and 8.

As shown in FIGS. 4 and 6, a control configuration is enabled using pressurized engine oil from the supply passage 54 that flows through the 3-way valve into a 4-way pulse width modulation control valve 20 for closed-loop control. The 4-way valve is in fluid communication with an advancing fluid passage 60 and a retarding fluid passage 62 in the camshaft 50 that communicate through aligned apertures 76 in a sleeve portion 74 of the locking plate 70 to the advance and retard chambers 12 and 14 between the hub 40 and housing 24. When the locking plate 70 is in the unlocked position, oil may flow to and from the advance and retard chambers 12 and 14 with respect to the 4-way valve 20.

As shown in FIG. 7, however, when the locking plate 70 is in the locked position, the aligned apertures 76 of the slidable annular member do not align with the advancing fluid passage 60 and retarding fluid passage 62, and therefore block flow of engine oil to and from the 4-way valve 20 with respect to the advance and retard chambers 12 and 14.

In operation, as shown in FIG. 4, when the engine is started the pressurized oil begins to flow through the camshaft bearing 52 and into the 3-way valve 16 and through the 3-way valve 16 into the 4-way valve 20. The engine control unit 18 processes input information from sources within the engine and elsewhere, then sends output information to various sources including the 3-way valve 16. The 3-way valve 16 directs engine oil to the locking passage 56 based upon output from the engine control unit 18 to unlock the locking plate 70, which then allows the vane phaser 10 to shift phase. The engine control unit may then signal the 4-way valve 20 to direct oil from a supply port 20S to a retard port 20R through to the retarding fluid passage 62 and into the retard chambers 14. Simultaneously, engine oil is allowed to exhaust from the advance chambers 12 through the advancing fluid passage 60 into an advance port 20A of the 4-way valve 20 and out an exhaust port 20E. Alternatively, as shown in FIG. 6, the engine control unit 18 may signal the 4-way valve 20 to direct oil from the supply port 20S to the advance port 20A through the advancing fluid passage 60 and into the advance chambers 12. Simultaneously, engine oil is allowed to exhaust from the retard chambers 14 through the retarding fluid passage 62 into the retard port 20R of the 4-way valve 20 and out the exhaust port 20E.

As shown in FIG. 7, once the desired phase shift has been achieved, the engine control unit 18 will signal the 3-way valve 16 to permit the oil to exhaust from the locking plate 70 through the locking passage 56 through a locking port 16L of the 3-way valve 16 and out an exhaust port 16E. Simultaneously, all engine oil flow to and from the advance and retard chambers 12 and 14 with respect to the 4-way valve 20 will cease since the locking plate 70 slides to a locked position to block oil flow and lock the vane phaser in position.

Figure 9:
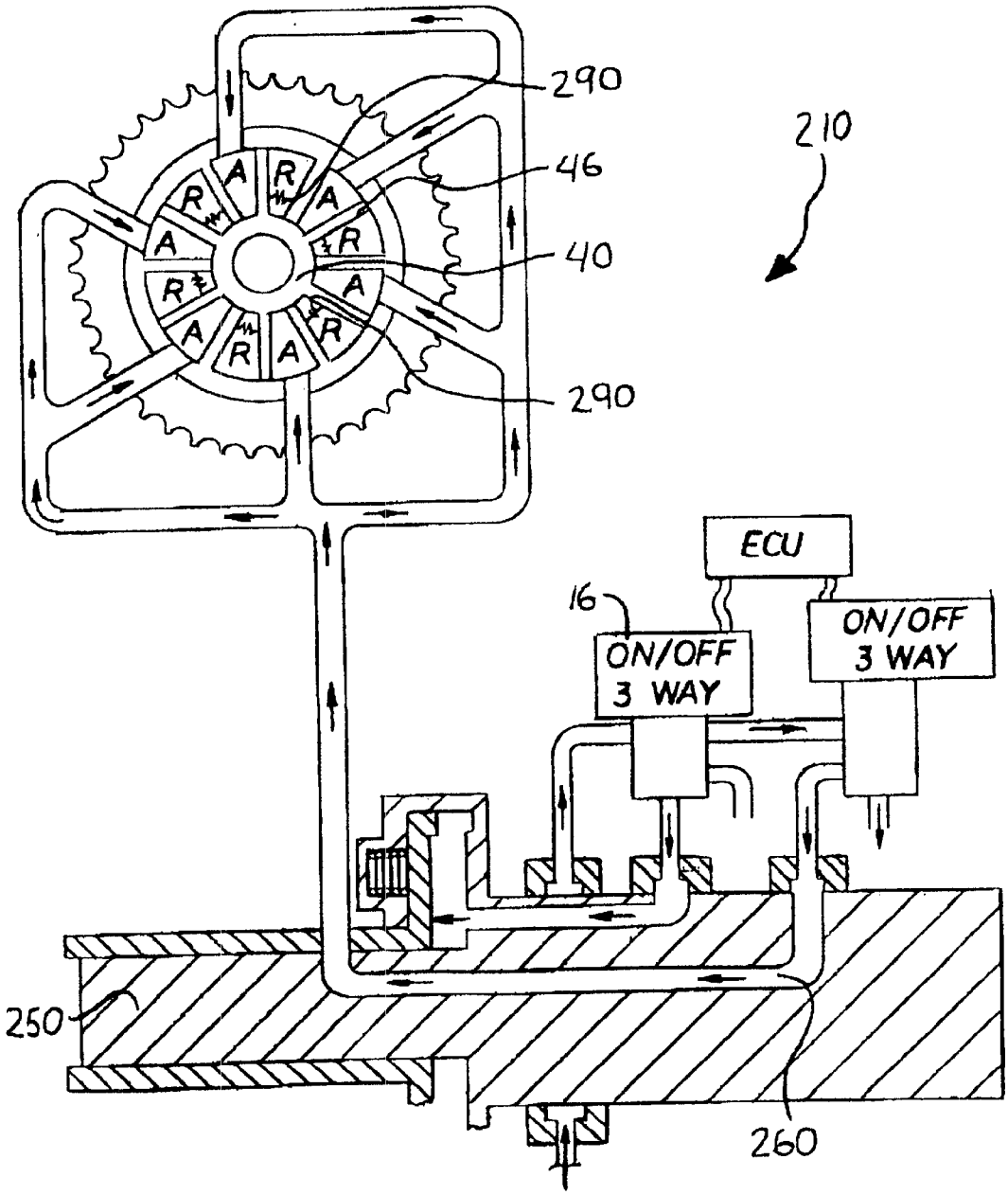
FIG. 9 is a schematic view of the hydraulic equipment of the variable camshaft timing arrangement according to an alternative embodiment of the present invention and illustrates a phase shift where the position of the camshaft is changing from neutral position to an advance position, and further illustrates use of a three-way solenoid to unlock the housing from the camshaft.
Figure 9A:
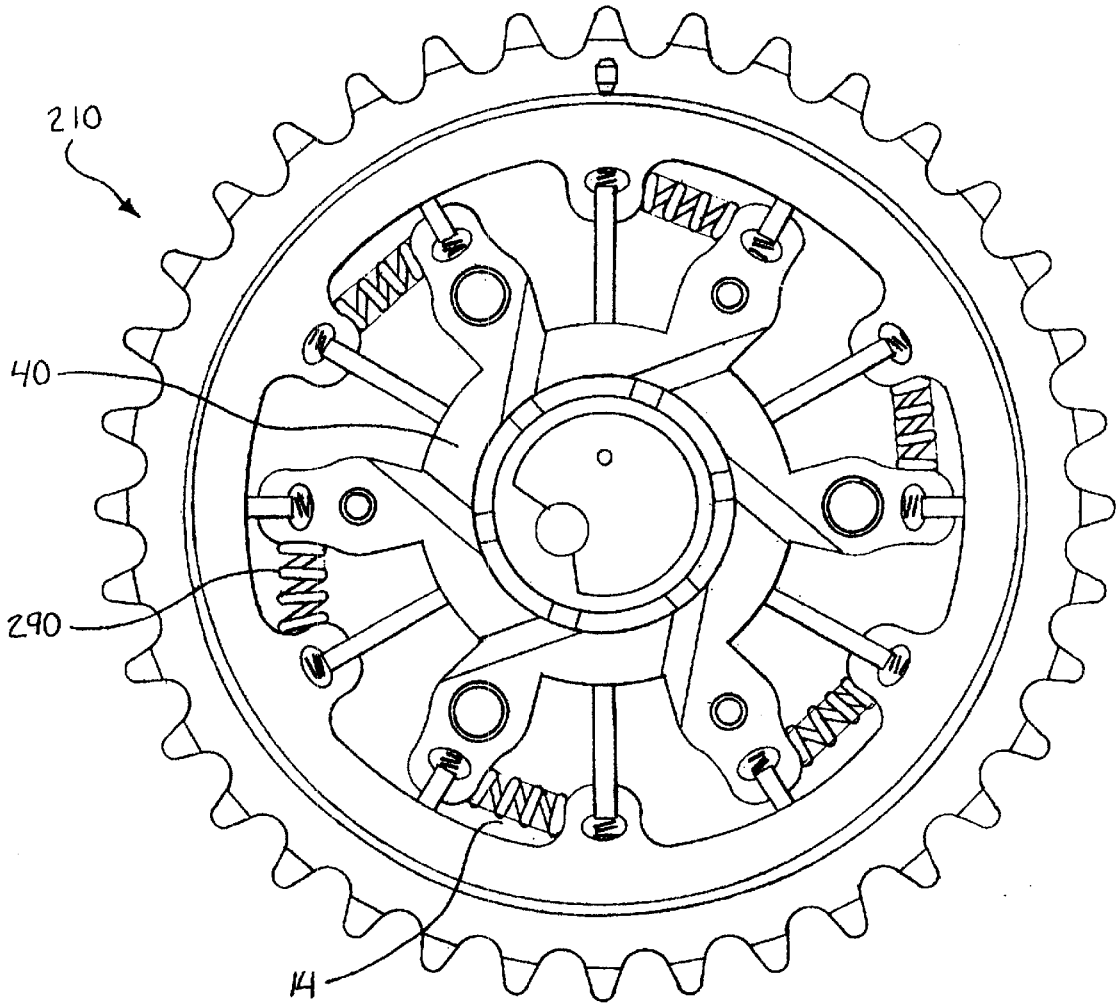
FIG. 9A is an end view of another camshaft and vane phaser according to the present invention.

FIGS. 9 and 9A illustrate a vane phaser 210 according to an alternative embodiment of the present invention. FIG. 9 illustrates how the 3-way valve 16, an advancing fluid passage 260 in a camshaft 250, and bias members 290 in each of the retard chambers 14 perform the phase shift of the camshaft 250 under closed-loop control. Here, the bias members 290 act upon the driven vanes 46 to bias the hub 40 and driven vanes 46 in a fully retarded position under 0% duty cycle. Accordingly, in order to counterbalance the spring force of the bias members 290, oil pressure under 100% duty cycle flows from the supply passage 254 through the 3-way valve 16 and advancing fluid passage 260 into each of the advance chambers 12. Therefore, the phase shift is achieved simply by controlling flow of oil pressure into each advance chamber 12.

FIG. 9A illustrates that the vane phaser 210 incorporates compression springs for the bias members 290. Other springs, however, may be employed such as torsional springs, accordion springs, and beehive compression springs. It is contemplated that the bias on the hub 40 may also be achieved using a single spring member configuration (not shown). Additionally, the hub 40 may instead be normally biased toward the fully advanced position (not shown), whereby phase shift would be achieved by controlling flow into the retard chambers 14.

Figure 10:
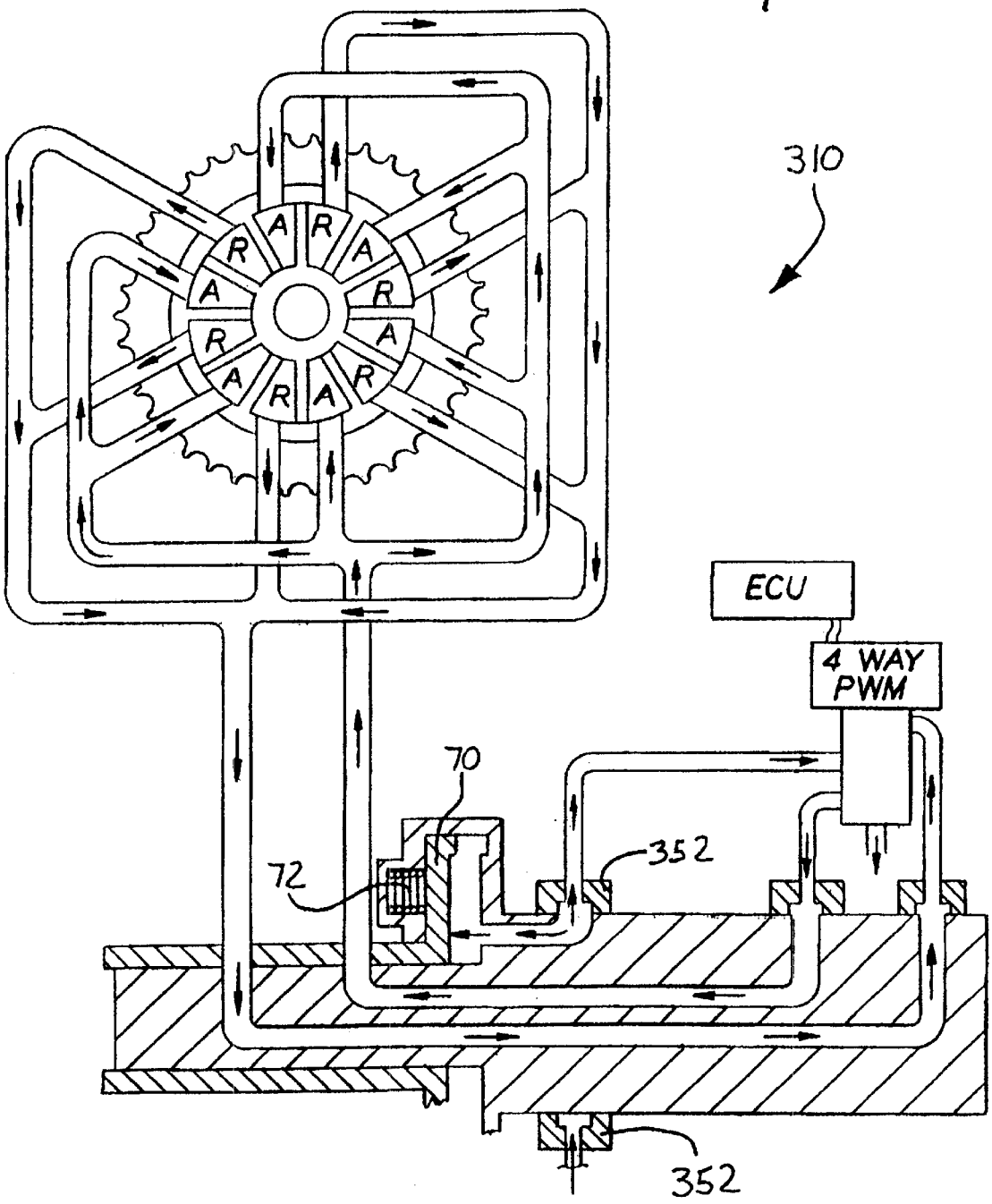
FIG. 10 is a schematic view of the hydraulic equipment of the variable camshaft timing arrangement according to another alternative embodiment of the present invention and illustrates a phase shift where the position of the camshaft is changing from neutral position to an advance position, and further illustrates oil pressure flowing directly to a locking piston to unlock the housing from the camshaft.

Finally, FIG. 10 also illustrates a vane phaser 310 according to an alternative embodiment of the present invention in which the locking plate 70 is always disengaged while oil flows through the camshaft bearing 52 mounted around a camshaft 350. In this configuration, once oil pressure is high enough to overcome the force of the return spring 72 the locking plate 70 will disengage. Therefore, the locking plate 70 will be disengaged all the time that the engine is running and supplying oil pressure. Accordingly, the vane phaser 310 will be able to move to any position within the accuracy of the phaser control scheme.

From the above, it can be appreciated that a significant advantage of the present invention is that no check valves or spool valves are required, and thus the VCT will likely be less susceptible to contamination problems.

An additional advantage is that the VCT of the present invention maintains a similar dimensional size as current self-powered VCT phaser mechanisms, yet operates effectively from engine oil pressure and does not require actuation from torque pulses from the camshaft. In order to reduce the size of the vane phaser, the present invention includes a vane phase configuration of less cross-sectional area and having more vane chambers to achieve comparable volume with respect to prior art vane phasers. Accordingly, the phaser can achieve 30 degrees of cam phase rotation yet maintain a cross-sectional width of less than 15 mm.

Another advantage is that the VCT of the present invention shares many characteristics with traditional vane-style pumps and therefore may share vane pump componentry and the benefit of long established vane pump design and manufacturing principles.

Yet another advantage is that no additional seal system is required to seal the alternating advance and retard chambers since the driving and driven vanes are spring loaded into constant contact with the hub and housing respectively.

While the present invention has been described in terms of a preferred embodiment, it is apparent that other forms could be adopted by one skilled in the art. For example, an open-loop control strategy could be employed to achieve the phase shift of the camshaft. Likewise, alternative control valve devices may be employed to control fluid flow. Additionally, the reader's attention is directed to all papers and documents filed concurrently with or previous to this specification in connection with this application and which are open to public inspection with this specification, and the contents of all such papers and documents are incorporated herein by reference. Accordingly, the scope of the present invention is to be limited only by the following claims.

The present invention, in which an exclusive property or privilege is claimed, is defined as follows:

1. An internal combustion engine comprising;

a camshaft;

a hub secured to said camshaft for rotation therewith, said hub having an external surface thereon;

a housing circumscribing said hub, said housing having an internal surface thereon, said housing being rotatable with said hub and said camshaft and being oscillatable with respect to said hub and said camshaft;

a substantially circumferentially evenly spaced plurality of driven vanes radially disposed in said hub and alternating with said plurality of driving vanes and cooperating with said external surface of said housing;

a substantially circumferentially evenly spaced plurality of driven vanes radially disposed in said hub and alternating with said plurality of driving vanes and cooperating with said internal surface of said housing;

said plurality of driving and driven vanes defining a plurality of substantially circumferentially equal alternating advance and retard chambers;

locking means for preventing relative motion between said housing and said hub in at least one position between a fully advanced position of said hub relative to said housing and a fully retarded position of said hub relative to said housing, said locking means being reactive to engine oil pressure; and means for controlling oscillation of said housing relative to said hub.

2. The internal combustion engine as claimed in claim 1, wherein said housing includes a first set of locking teeth and further wherein said locking means comprises:

a locking plate circumscribing a portion of said camshaft;

locking ring connected to said locking plate, said locking ring including a second set of locking teeth being in engagement with said first set of locking teeth of said housing in a locked position to prevent relative circumferential motion between said hub and said housing, and being out of engagement with said first set of locking teeth in an unlocked position to permit relative circumferential motion between said hub and said housing; and resilient means for biasing said locking plate and said locking ring toward said locked position.

3. The internal combustion engine as claimed in claim 2, wherein said locking ring is coaxially positioned relative to the longitudinal axis of said camshaft and is moveable along the longitudinal axis of said camshaft between said locked position and said unlocked position.

4. The internal combustion engine as claimed in claim 3, wherein said locking plate has a radially extending flange and wherein said resilient means engages an axial surface of said radially extending flange.

5. The internal combustion engine as claimed in claim 4, wherein said locking means further comprises:

a passage extending through said camshaft for delivering engine oil pressure to said locking plate, where engine oil pressure acts against an opposed axial surface of said radially extending flange of said locking plate to counteract a force imposed on said locking plate by said resilient means.

6. The internal combustion engine as claimed in claim 5 further comprising:

a control valve for controlling flow of engine oil pressure into said passage extending through said camshaft.

7. The internal combustion engine as claimed in claim 6 further comprising:

an electronic engine control unit for controlling operation of said control valve to control whether said control valve operates in an on mode or in an off mode.

8. The internal combustion engine as claimed in claim 1, wherein said controlling means comprises:

an electronic engine control unit;

valving means for directing engine oil pressure and being responsive to said electronic engine control unit;

advancing means for communicating engine oil pressure between said valving means and said plurality of advance chambers; and retarding means for communicating engine oil pressure between said valving means and said plurality of said retard chambers.

9. The internal combustion engine as claimed in claim 8, wherein said advancing means includes neither a check valve nor a spool valve.

10. The internal combustion engine as claimed in claim 8, wherein said valving means includes a control valve comprising:

an advance control port communicating with said advancing means, a retard control port communicating with said retarding means, a supply port for supplying engine oil pressure, and an exhaust port for exhausting engine oil pressure.

11. The internal combustion engine as claimed in claim 8, wherein each of said plurality of driving vanes is biased against each of said plurality of said driven vanes to maximize the volume of either said plurality of advance chambers or said plurality of retard chambers, and said controlling means including either said advancing means or said retarding means respectively supplying one of said plurality of advance chambers and said plurality of retard chambers with engine oil pressure to counterbalance said plurality of driving vanes biased against said plurality of driven vanes.

12. An internal combustion engine comprising:

a camshaft;

a hub secured to said camshaft for rotation therewith, said hub having an external surface thereon;

a housing circumscribing said hub to define a fluid chamber therebetween, said housing having an internal surface thereon, said housing being rotatable with said hub and said camshaft and being oscillatable with respect to said hub and said camshaft;

a substantially circumferentially evenly spaced plurality of driving vanes radially disposed in said housing and extending in an inwardly radial direction therefrom into said fluid chamber and cooperating with said external surface of said hub;

a substantially circumferentially evenly spaced plurality of driven vanes radially disposed in said hub and extending radially outwardly therefrom into said fluid chamber and cooperating with said internal surface of said housing;

said plurality of driving and driven vanes dividing said fluid chamber into a plurality of substantially circumferentially equal advance chambers and a plurality of retard chambers circumferentially interspersed with said plurality of advance chambers;

locking means for preventing relative motion between said housing and said hub in at least one position between a fully advanced position of said hub relative to said housing and a fully retarded position of said hub relative to said housing, said locking means being reactive to engine oil pressure; and means for controlling oscillation of said hub relative to said housing, said means for controlling comprising means for porting said plurality of advance and retard chambers with engine oil pressure to relative displace said plurality of driving and said plurality of driven vanes.

13. The internal combustion engine as claimed in claim 12, wherein said housing includes a first set of locking teeth and further wherein said locking means comprises:

a locking plate circumscribing a portion of said camshaft;

a locking ring connected to said locking plate, said locking ring including a second set of locking teeth being in engagement with said first set of locking teeth of said housing in a locked position to prevent relative circumferential motion between said hub and said housing, and being out of engagement with said first set of locking teeth in an unlocked position to permit relative circumferential motion between said hub and said housing, said locking plate being coaxially positioned relative to the longitudinal axis of said camshaft and moveable along the longitudinal axis of said camshaft between said locked and said unlocked position; and resilient means for biasing said locking plate and said locking ring toward said locked position.

14. The internal combustion engine as claimed in claim 13, said locking means further comprising:

a radially extending flange thereon and wherein said resilient means engages an axial surface of said radially extending flange; and a passage extending through said camshaft for delivering engine oil pressure to said locking plate, where engine oil pressure acts against an opposed axial surface of said radially extending flange of said locking plate for counterbalancing a force imposed on said locking plate by said resilient means.

15. The internal combustion engine as claimed in claim 14 further comprising:

an on/off control valve for controlling flow of engine oil pressure into said passage extending through said camshaft; and an electronic engine control unit for controlling operation of said on/off control valve to control whether said on/off control valve operates in an on mode or in an off mode.

16. The internal combustion engine as claimed in claim 12, wherein said controlling means further comprises:

an electronic engine control unit;

valving means for directing engine oil pressure and being responsive to said electronic engine control unit;

advancing means for communicating engine oil pressure between said valving means and said plurality of advance chambers, wherein said advancing means comprises an advancing fluid passage through said camshaft, said hub, and said locking means, said advancing fluid passage communicating with said advance chambers, whereby engine oil pressure flows freely through said advancing fluid passage when said locking means is in said unlocked position and engine oil pressure is blocked when said locking means is in said locked position; and retarding means for communicating engine oil pressure between said valving means and said plurality of said retard chambers, wherein said retarding means comprises a retarding fluid passage through said camshaft, said hub, and said locking means, said retarding fluid passage communicating with said retard chambers, whereby engine oil pressure flows freely through said retarding fluid passage when said locking means is in said unlocked position and engine oil pressure is blocked when said locking means is in said locked positions.

17. The internal combustion engine as claimed in claim 16, wherein said advancing means includes neither a check valve nor a spool valve.

18. The internal combustion engine as claimed in claim 16, wherein said valving means includes a four-way pulse-width-modulated valve comprising:

an advance control port communicating with said advancing means, a retard control port communicating with said retarding means, a supply port for supplying engine oil pressure, and an exhaust port for exhausting engine oil pressure.

19. The internal combustion engine as claimed in claim 16, wherein each of said plurality of driving vanes is biased against each of said plurality of said driven vanes to maximize the volume of either said plurality of advance chambers or said plurality of retard chambers, and said controlling means including either said advancing means or said retarding means respectively supplying one of said plurality of advance chambers and said plurality of retard chambers with engine oil pressure to counterbalance said plurality of driving vanes biased against said plurality of driven vanes.

20. An internal combustion engine comprising:

a crankshaft;

a camshaft linked to and rotatably driven by said camshaft;

a hub secured to said camshaft for rotation therewith, said hub having an external surface thereon, said hub further having inwardly extending radial slots open to said external surface and being substantially circumferentially evenly spaced apart, said hub being non-oscillatable with respect to said camshaft;

a housing circumscribing said hub, said housing having an internal surface thereon, said housing being rotatable with said hub and said camshaft and being oscillatable with respect to said hub and said camshaft, said housing further having outwardly extending radial slots open to said internal surface and being substantially circumferentially evenly spaced apart, said internal surface being circumferentially larger than said external surface of said hub thereby defining a fluid chamber therebetween;

a plurality of driving vanes radially and slidably disposed in said outwardly extending radial slots of said housing and corresponding in quantity to said outwardly extending radial slots of said housing, each of said plurality of driving vanes having an inner edge engaging said external surface of said hub, said plurality of driving vanes being spring-loaded radially inwardly to ensure constant contact with said external surface of said hub;

a plurality of driven vanes radially and slidably disposed in said inwardly extending radial slots of said hub and corresponding in quantity to said inwardly extending radial slots of said hub, each of said plurality of driven vanes having an outer edge engaging said internal surface of said housing, said plurality of driven vanes being spring-loaded radially outwardly to ensure constant contact with said internal surface of said housing;

said plurality of driving and driven vanes defining a plurality of advance chambers and a plurality of retard chambers circumferentially alternatively interspersed among said plurality of advance chambers within said fluid chamber, said plurality of alternating advance and retard chambers being fluid tightly separated from each other;

locking means for preventing relative motion between said housing and said hub in at least one position between a fully advanced position of said hub relative to said housing and a fully retarded position of said hub relative to said housing, said locking means being reactive to engine oil pressure; and means for controlling oscillation of said hub relative to said housing, said means for controlling comprising means for porting said plurality of advance chambers, and means for porting said plurality of retard chambers, said means for controlling being capable of supplying said plurality of alternating advance and retard chambers with engine oil pressure and being capable of exhausting said plurality of alternating advance and retard chambers of engine oil pressure to relatively displace said plurality of driving and driven vanes.

21. The internal combustion engine as claimed in claim 20, wherein said housing includes a first set of locking teeth and further wherein said locking means comprises:

a locking plate circumscribing a portion of said camshaft;

a locking ring connected to said locking plate, said locking ring including a second set of locking teeth being in engagement with said first set of locking teeth of said housing in a locked position to prevent relative circumferential motion between said hub and said housing, and being out of engagement with said first set of locking teeth in an unlocked position to permit relative circumferential motion between said hub and said housing; and resilient means for biasing said locking ring and locking plate toward said locked position.

22. The internal combustion engine as claimed in claim 21, wherein said controlling means further comprises:

an electronic engine control unit;

valving means for directing engine oil pressure and being responsive to said electronic engine control unit;

advancing means for communicating engine oil pressure between said valving means and said plurality of advance chambers; and retarding means for communicating engine oil pressure between said valving means and said plurality of said retard chambers.

23. The internal combustion engine as claimed in claim 20, wherein said advancing means includes neither a check valve nor a spool valve.

* * * * *